US005513963A

United States Patent [19]

Walton

[11] Patent Number: 5,513,963

[45] Date of Patent: May 7, 1996

[54] DIRECT ACTION FLUID MOTOR AND INJECTION PUMP

[75] Inventor: Frank A. Walton, Argyle, Tex.

[73] Assignee: Frank and Robyn Walton 1990 Family Trust, Argyle, Tex.

[21] Appl. No.: 291,362

[22] Filed: Aug. 16, 1994

[51] Int. Cl.[6] ..... F04B 9/10; F01L 15/12

[52] U.S. Cl. ..... 417/403; 91/224; 91/227; 91/229; 137/99

[58] Field of Search ..... 417/403; 137/99; 91/224, 227, 229, 346

[56] References Cited

U.S. PATENT DOCUMENTS

| | | | |
|---|---|---|---|
| Re. 29,193 | 4/1977 | Carlyle | 137/99 |
| 2,658,485 | 11/1953 | Dreyer | 121/164 |
| 3,213,873 | 10/1965 | Cordis | 137/99 |
| 3,753,528 | 8/1973 | Gibbs | 239/61 |
| 3,901,313 | 8/1975 | Doniguian et al. | 166/64 |
| 3,937,241 | 2/1976 | Cloup | 137/99 |
| 4,060,351 | 11/1977 | Cloup | 417/520 |
| 4,558,715 | 12/1985 | Walton et al. | 137/99 |
| 4,610,192 | 9/1986 | Hartley et al. | 91/341 |
| 4,756,329 | 7/1988 | Cloup | 137/99 |
| 4,809,731 | 3/1989 | Walton et al. | 137/99 |
| 4,832,071 | 5/1989 | Rehfeld | 137/99 |
| 5,002,468 | 3/1991 | Murata et al. | 417/401 |
| 5,055,008 | 10/1991 | Daniels et al. | 417/403 |
| 5,137.435 | 8/1992 | Walton | 417/403 |
| 5,243,897 | 9/1993 | Walton et al. | 91/224 |
| 5,244,361 | 9/1993 | Solomon | 417/403 |

FOREIGN PATENT DOCUMENTS 595458 12/1947 United Kingdom .

*Primary Examiner*—Richard E. Gluck
*Attorney, Agent, or Firm*—Harris, Tucker & Hardin

[57] ABSTRACT

A direct action fluid motor and injection pump is disclosed which injects small quantities of a second fluid into a primary fluid stream. A housing has an inlet and an outlet connected to a primary fluid conduit. The housing contains a stepped piston which reciprocates in response to the fluid pressure applied alternately to the closed small and large face of the piston. A valve set alternately closes one and opens the other of the faces. A valve positioner carried with the piston is held in alternate stable positions by cooperating springs on the valve positioner and a post in the piston. Stop members are located above and below the piston travel, each associated with an actuating spring. The valve positioner is preshifted at the end of the stroke, using the full force of the piston, by stop members to move the valve positioner and valve set to an intermediate unstable position. When the closed valves on the closed face are unseated a small distance, a relatively weak actuating spring can then fully shift the valve positioner and valves to change the direction of reciprocation. The injection pump has a pump casing connected in sealed contact with the motor housing and has an outlet leading to the secondary fluid. A reciprocating pump mechanism connected to the piston has a selectively adjustable sliding valve member which closes the pump chamber at a plurality of predetermined positions of the pump mechanism. The pump mechanism displaces fluid from the pump chamber without sliding seals. Displaced secondary fluid travels under pressure through a control passage to mix with primary fluid at the outlet of the pump housing. The pump casing is quickly and easily removable for access to the pump mechanism to rapidly adjust the ratio of secondary fluid. The pump self primes automatically with primary fluid, if needed, at the bottom of its stroke.

51 Claims, 6 Drawing Sheets

DIRECT ACTION FLUID MOTOR AND INJECTION PUMP

BACKGROUND OF THE INVENTION

1. Field of the Invention

The invention pertains to an improved in-line fluid operated motor coupled to an injection pump for injecting predetermined quantities of secondary fluid into a primary fluid stream.

2. Background of the Prior Art

Fluid powered motors have been know in the prior art for driving a pump connected to a source of fluid additives. A fluid powered motor installed in a line containing primary fluid reciprocates to draw a quantity of secondary fluid into the primary fluid with each reciprocation. Such devices have been applied to add medication to drinking water for poultry and livestock, treat water with additives, add fertilizer concentrate to irrigation water, or add lubricant or cleaning agents to water.

In conventional reciprocating fluid power motors, a sliding shaft extends through the head of a differential stepped piston, usually through the center of the piston and extends on both sides of the piston face. The shaft is connected to some snap over center or toggle mechanism to control two sets of "poppet" valves which alternately open and close fluid passages in a one stepped piston face or in two stepped piston faces. When the piston moves up or down in response to high pressure on one side of the stepped face, an end of the rod strikes the housing and causes the rod to stop moving while the piston continues to move. This causes a relative sliding movement between the rod and the pressurized face of the piston which requires a seal to prevent loss of pressure.

Newer designs, such as the one disclosed in U.S. Pat. No. 5,137,435, have eliminated the need for a sliding seal between a shifting mechanism and the upper face of the stepped piston, but there is still a need for compressing a strong spring in a snap-over center mechanism to insure that sets of valves in each face of the piston are shifted. There is a fluid pressure induced force on the poppet valves of the closed face of the piston which must be overcome by the shifting mechanism to shift the poppet valves. A large amount of energy is stored in compressed springs which drives a valve shifter in a snap-over center action. Although considerably better than older designs which employ springs which are stretched in tension, there is still considerable noise produced which is objectionable in certain installations. A case in point is the installation of such a unit in a home sprinkling system where the reciprocating unit is placed in close proximity to a bedroom. There is still enough noise to wake certain people when the unit winds the springs, then suddenly drives the valves to the opposite position to change the direction of reciprocation. There is still undesirable excessive wear and tear because of the required high driving force of the shifting mechanism applied to working parts. If the springs are too weak or too small, the unit will not reliably shift at all. It would be desirable to produce an in-line fluid pressure operated motor which does not require a snap-over center shifting mechanism to reverse the valve orientation.

Such a reciprocating fluid powered motor is used to drive an injection pump. An injection pump is connected to the reciprocating motor housing. It has an inlet leading to a source of secondary fluid. Prior art injection pumps rely on too many sliding seals which wear out too rapidly if the secondary fluid contains abrasive particles. Some prior art injection pumps can be adjusted to deliver a greater or lesser quantity of secondary fluid per reciprocation, but adjustment requires the use of tools to disassemble the pump and require too much time to make the adjustment. They often produce an unreliable or unknown quantity of injected fluid. It would be desirable to have an improved injection that can be disassembled easily, reduces reliance on sliding seals which can wear in contact with an abrasive fluid, is self-priming, draws in excess fluid, and is reliably and predictably adjustable.

SUMMARY OF THE INVENTION

I have discovered that the full pressure: force applied to the closed face of a stepped piston in the motor housing by pressurized primary fluid flowing through the motor can be used to unseat or "crack" poppet valves on the closed face of the piston, thereby overcoming the initial resistance to shifting which is characteristic of reciprocating motors of this kind. This is referred to as preshifting of a valve train, which includes the lower poppet valves, a valve positioner and the upper poppet valves, to an intermediate unstable position between two alternate stable positions and includes a holding means associated with the valve positioner which tends to hold the valve positioner in one of the alternative stable positions.

Once the initial resistance to shifting is overcome by using the large pressure force on the piston to preshift the valve train to the intermediate unstable position, only a relatively small shifting force is then required to shift the valve train to one of the alternate stable positions to thereby fully open the face of the piston that was closed and close the face of the piston that was open. The relatively small shifting force that is used to shift the valve train to a stable position is provided by an actuating means which is compressed as the piston nears the end of its stroke. The shifting force applied by the actuating means may be applied to the valve train through the valve positioner or to the valve memos in one of the piston faces.

A fluid pressure operated motor, for quietly reciprocating a fluid injection pump to inject predetermined quantities of a secondary fluid into a primary fluid stream, comprises a housing having interior walls and an inlet and outlet for connection in fluid communication with pressurized primary fluid in an operating fluid line. A stepped piston is mounted for reciprocation in the housing, said stepped piston having a larger diameter portion with a large face and a smaller diameter portion with a smaller face, in sliding sealed contact with the interior walls of the housing. The smaller face of the piston divides the interior of the housing into a first variable chamber below the face and second variable chamber above the face.

A first passageway in the housing leads from the inlet to the first variable chamber and a second passageway leads from the second variable chamber to the outlet, whereby operating fluid under pressure can traverse the housing by moving in a controlled path through the first and second chambers.

A valve train carried by the piston comprises a valve positioner and a cooperating valve set operatively configured to axially shift together relative to the piston between alternate stable positions and an intermediate unstable position, the valve train including a holding mechanism which applies a holding force to the valve positioner which resists movement of the valve positioner and the remainder of the valve train from an alternate stable position to the intermediate unstable position. The valve set comprises first valve means to open and close the smaller face of the piston and a second valve means to open and close the large face of the piston, the valve set being shiftable together with the valve positioner to alternately close one of said piston faces while opening the other of said piston faces at each of the alternate stable positions of the valve train.

Actuating means in the housing applies a shifting force to the valve train, said shifting force being less than the force required to shift the valve train against the pressure force on the closed first or second valve means caused by pressurized fluid in the housing. A first stop means is positioned to stop the valve train as the piston is moving in one direction of reciprocation, and a second stop means is positioned to stop the valve train as the piston is moving in the other direction of reciprocation, thereby preshifting the valve train to the intermediate unstable position and partially opening the closed face of the piston by unseating one of the first or second valve means until the shifting force applied by the actuating means exceeds the remaining pressure force on the unseated first or second valve means, whereupon the valve train immediately moves to an alternate stable position in response to the shifting force applied to the valve train by said actuating means, thereby closing the face of the piston that was open and fully opening the face of the piston that was partially open in response to unseating one of the first or second valve means.

The full force applied by the pressurized fluid to the closed face of the piston is used to preshift the valve train to reduce the pressure force on the valve means at the closed face so that only a comparatively small shifting force is required to fully shift the valve positioner and valve set to reverse the direction of reciprocation of the piston.

The actuating means comprises biasing elements associated with the stop members whereby the shifting force is alternately applied to the valve train by one of the biasing elements near the end of the piston stroke to shift the valve train when the valve positioner reaches its intermediate unstable position.

The holding mechanism which holds the valve train in the alternate stable positions comprises a cooperating spring and detent combination positioned within the piston, wherein the center portion of the piston is equipped with a post containing said detent and the valve positioner has a spring element which cooperates with said detent to establish the alternate stable positions of the valve positioner. The post is fixed to the piston or formed as a part thereof, and the spring element is fixed to the valve positioner. Alternatively, the detent could be fixed at the wall of the valve positioner and the spring element mounted on the post which is fixed to the piston. The detent can be regarded as having angled cam surfaces and the spring element comprising a cooperating cam follower which are configured to hold the valve positioner in either of the alternate stable positions in opposition to the shifting force applied to the valve train by the actuating means.

Major advantages are provided by this construction in the form of reduced pounding of the parts every time the valves shift which significantly reduces wear and maintenance. It does not require excessively heavy or expensive materials to withstand the pounding. Equally important, the pounding of other reciprocating motors of this type creates loud noise which is disturbing when such a unit is employed in a domestic home sprinkler system which is most commonly operated in the early morning hours. Very little noise is produced by the new design to wake people undesirably.

The improved direct action pump motor operates an improved positive displacement pump quickly and easily removable from a well in the bottom of the motor housing. A pump casing is sealingly mounted in the well and held by a U-shaped wire member which slides into transverse holes which include half-round sections in peripheral walls of the pump casing and the wall which forms the well. The back end of an elongated pump member is fixed to the bottom of the piston for reciprocation therewith. The elongated member has a front portion with a plurality of spaced apart keeper grooves and contains a sliding valve member having a valve to seal the inlet of the casing which is attached to a source of the secondary fluid. The sliding valve member is selectively extendable from the elongated body by the placement of the keeper in a selected keeper groove. On the upstroke, excess secondary fluid is drawn into the pump chamber. On the downstroke, the excess secondary fluid is expelled and then the secondary fluid outlet is closed by seating of the valve on the sliding valve member. The remaining secondary fluid in the pump casing is then displaced by the downwardly extending elongated body. The secondary fluid is forced into an outlet chamber in the well and opens a one-way flow valve to reach the outlet of the housing where it mixes with the primary fluid. Secondary fluid which often contains abrasive material is excluded from the motor chambers inside the housing to prevent wear on the reciprocating piston, valves and seals. The excess fluid drawn in on each stroke insures that the proper quantity is available for displacement so that the predetermined amount is always injected.

The elongated body enters the pump casing through a seal at the top of the pump casing. When the pump is fully extended a necked portion of elongated body moves away from the seal at the top of the pump casing and allows primary fluid to pass into the pump chamber if the pump chamber is not already filled with fluid. This produces a completely automatic self-priming injection pump which will fill itself and operate even from a dry starting condition. There are no internal seals within the pump other than the single seal which simultaneously closes the opening at the top of the pump casing and provides a seal for the elongated body. This seal is easily reached and replaced by the quick removal device which secures the pump casing in the well. The quick removal device also facilitates removing the pump casing from the elongated body and exposing the keeper and keeper grooves which are quickly and easily positioned in a different groove to produce the different predetermined milo of secondary fluid to primary fluid for each reciprocation of the pump.

The keeper precisely controls the posit on of the sliding valve member and when the secondary fluid inlet is closed. The grooves are precalibrated to define a specific ratio of secondary fluid which is precise and cannot vary because of wear or leakage of seals as is common with conventional injection pumps of this type.

An alternate injection pump has a pump casing with an enlarged lower portion with more room for an enlarged pump member which reciprocates with the piston to increase the displacement of the injection pump on each stroke. The downwardly extending portion of the pump casing surrounds an adjustable insert which contains the secondary fluid inlet and a seating surface for the sliding valve member. By raising or lowering the insert with respect to the pump casing, the displacement of the pump can be varied.

DESCRIPTION OF THE PREFERRED EMBODIMENT

Figure 1:
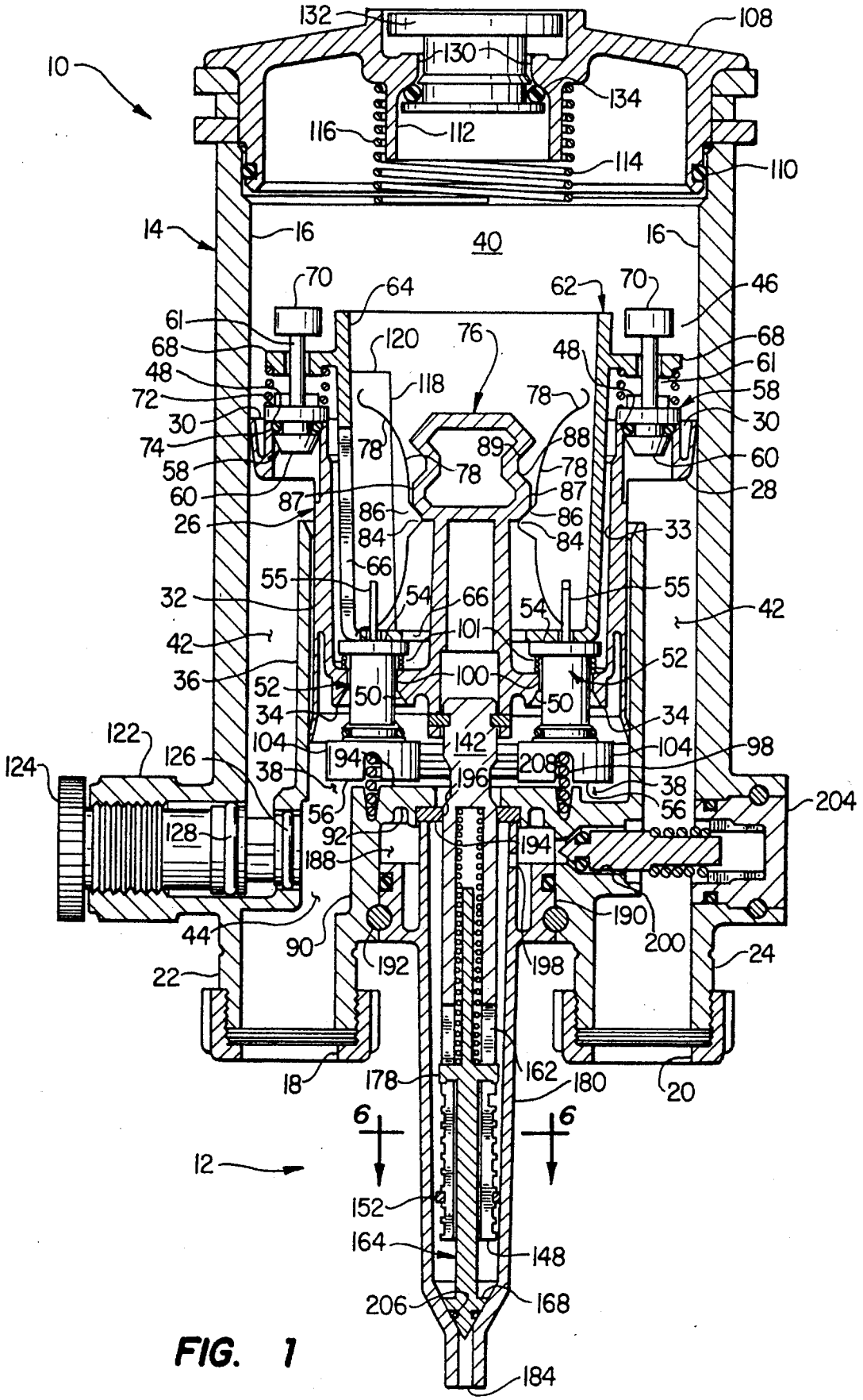
FIG. 1 is a longitudinal central section view of the direct action fluid motor and coupled injection pump with the piston moving downward just before the lower valve members reach a stop surface.

In the description which follows, like parts are marked with the same reference numerals. The drawing figures are not necessarily to scale, and certain features of the invention may be shown exaggerated in scale or in somewhat schematic form in the interest of clarity and preciseness.

FIGS. 1–4 generally show the same central cross-sectional view in elevation of the combined direct action fluid motor and pump assembly with a reciprocating piston in different positions of the cycle. The term direct action refers to the fact that the valve train comprising the valve means in the faces of the piston and a valve positioner are preshifted from a stable position to an unstable position without storing a large amount of energy in one or more strong springs. A relatively light actuating spring compressed during the preshifting action is used to move the valve positioner from the intermediate unstable position to an alternate stable position to fully shift the valve means to reverse the direction of reciprocation of the piston. The fluid pressure operated motor which may be referred to as the motor is generally designated by the reference numeral 10. The fluid injection pump which may be referred to as the pump is generally designated by the reference numeral 12. It will be understood that the parts are generally circular or cylindrical and the views shown are elevational.

Referring to FIG. 1, motor 10 has a cylindrical housing 14 having interior walls 16 with fluid inlet 18 and fluid outlet 20. The fluid inlet and outlet are accommodated by bosses 22 and 24 formed in the wall of housing 14. Bosses 22 and 24 are adapted to be connected to a primary fluid conduit, not shown, for conducting a pressurized primary liquid flow stream, such as water, into which a fluid additive is to be injected to flow with the liquid leaving passage 20 and thence travel through the conduit to an end use further downstream.

A stepped piston generally designated 26 is mounted for reciprocation in the housing. The stepped piston has a larger diameter portion 28 with a large face 30 in sliding sealed contact with interior wall 16. Stepped piston 26 has a smaller diameter portion 32 with a small face 34 mounted in sliding sealed contact with another interior wall 36 in the housing. The smaller face divides the interior of the housing into a first variable chamber 38 below the face and a second variable chamber 40 above the face. There is also a third variable chamber 42 formed below large diameter portion 28 between walls 16 and 36 which communicates around the circular periphery of interior wall 16 with outlet 20. When the piston is moving down, fluid trapped in chamber 42 is pushed through the outlet back into the conduit.

A first passageway 44 leads from inlet 18 to first variable chamber 38. A second passageway 46 leads from the second variable chamber 40 through an opening in the large face of the piston to outlet 20 through chamber 42. The large face 30 has one or more fluid openings 48. Since the small face 34 has one or more fluid openings 50, operating fluid from the primary fluid stream can traverse the housing by moving in a controlled path through the first and second chamber.

The piston carries a valve set comprising first valve means 52 to open and close the small face of the piston and second valve means 58 to open and close the large face of the piston. First valve means 52 is associated with small face 34 of the piston. It includes an internal control surface 54 and an external control surface 56. The internal control surface is inside the piston and may be referred to as an opening surface, because in cooperation with shifting of a valve positioner described below, it causes the first valve means 52 to open. The external control surface is outside the piston and may be referred to as a dosing surface because in cooperation with a first stop means, it causes the first valve means 52 to close. Valve means 52 could be one valve or a plurality of valves to correspond with the number of openings 50 in order to open and close small face 34. A second valve means 58 is associated with large face 30 of the piston to open and close one or more openings 48, comprising one valve member 60 for each opening 48. Second valve means 58 is operated by a valve positioner.

Figure 2:
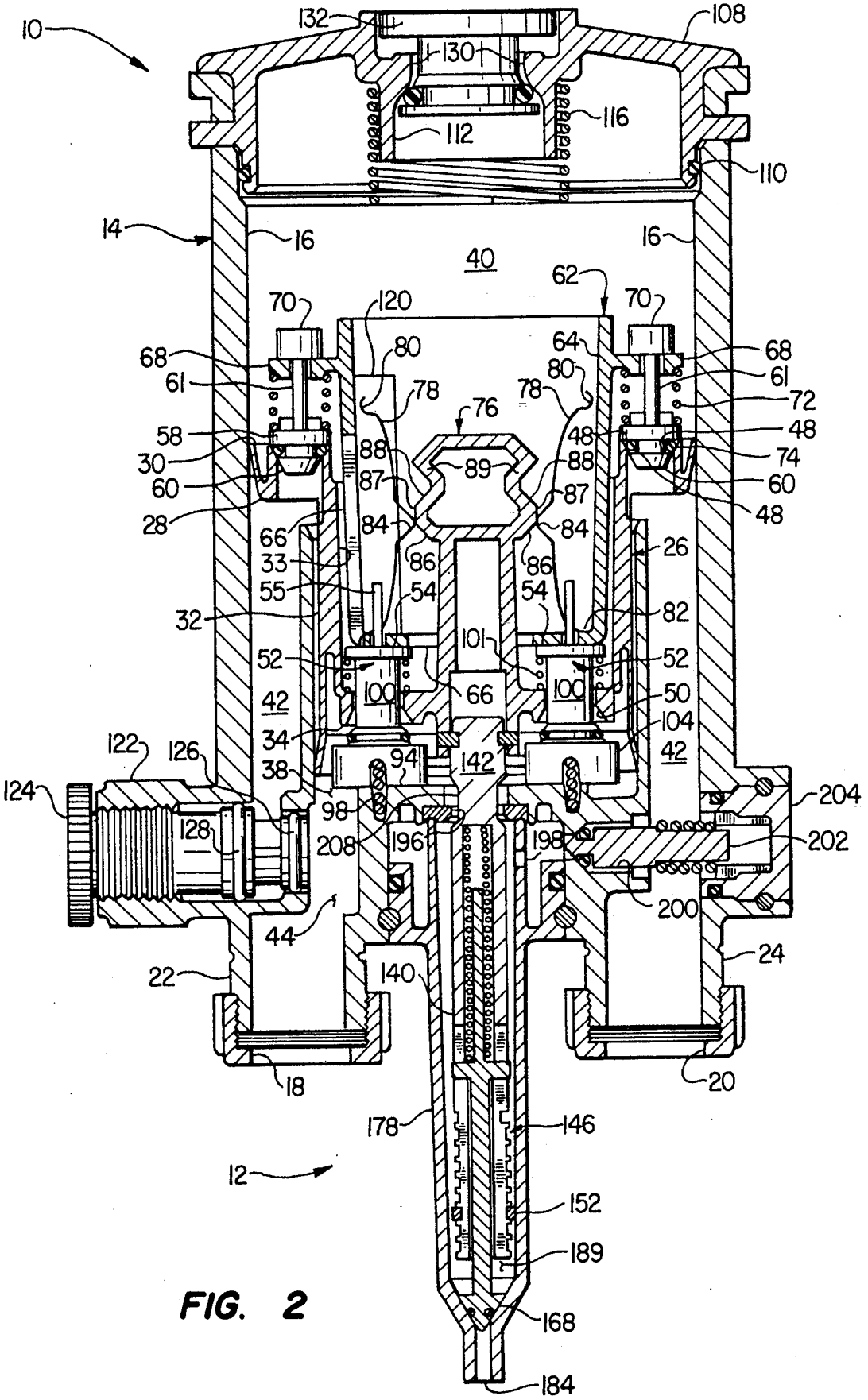
FIG. 2 is the same view as FIG. 1 with the piston near the end of its stroke and the valve positioner shifted from a stable position to an intermediate unstable position just as the closed valves are being unseated.

Referring now to FIG. 2, a valve positioner generally designated 62 is carried by piston 26 and reciprocates therewith. Valve positioner 62 is shiftable relative to piston 26 between the alternate stable positions of FIGS. 1 and 3 and the intermediate unstable position of FIG. 2. Valve positioner 62 is a cup-shaped member 64 slidingly mounted for axial movement partially within said smaller diameter portion 32 of the piston and having an upper end extending into second variable chamber 40 alive the stepped piston. The smaller diameter interior surface 33 of the stepped piston may include longitudinally extending ribs which extend radially inwardly to provide sliding support surfaces to the outer surface of valve positioner 62. Cup-shaped member 64 should contain suitable openings 66 so that primary fluid can flow through the interior of the piston through opening 50 without interference. Cup member 64 has lateral arms 68 which support valve members 60. Each valve member 60 has a seal 74 to sealingly fit a corresponding opening 48 in the larger face of piston 26. Valve member 60 is attached to longitudinally extending stem 61 which terminates in a head 70. Valve member 60 is biased away from lateral arm 68 by a poppet spring 72. Poppet spring 72 is a light spring that helps control the orientation of the valve members. Stem 61 and head 70 allow valve member 60 to be positioned spaced below the lower surface of arm 68 of the valve positioner. This allows axial movement of valve positioner 64 while valve members 60 remain sealed in respective openings 48. This axial movement is accompanied by compression or relaxation of the springs 72. When the valve positioner shifts upwardly relative to the piston, arms 68 catch heads 70 of valve member 60 to positively lift valve members 60 from openings 48.

Still referring to FIG. 2, the central interior of stepped piston 26 includes an upstanding post member generally designated 76. Post 76 is preferably formed in a wall of the piston and is an integral part of the piston. Valve positioner 62 is equipped with one or more biasing elements comprising a leaf spring 78 having a free end 80 and a fixed end 82 fixed to the bottom of valve positioner 62. Spring 78 has a bight 84 with angled cam follower surfaces pointed inwardly which cooperate with outwardly angled cam surfaces 86 and 88 formed on post 76. Spring 78 is like a cam follower wherein the sliding angled surfaces of bight 84 follow angled surfaces 86, 88, and a land 87 separate them as seen in FIG. 2. Surfaces 86 and 88 serve as detents in cooperation with bight 84 to establish a first alternate stable position of valve positioner 62 shown in FIG. 1 and a second alternate stable position of valve positioner 62 shown in FIG. 3. Thus, it can be seen that cup-shaped member 64 comprising valve positioner 62 can be shifted with respect to the stepped piston in the longitudinal axial direction between the alternate stable positions shown in FIGS. 1 and 3.

Figure 3:
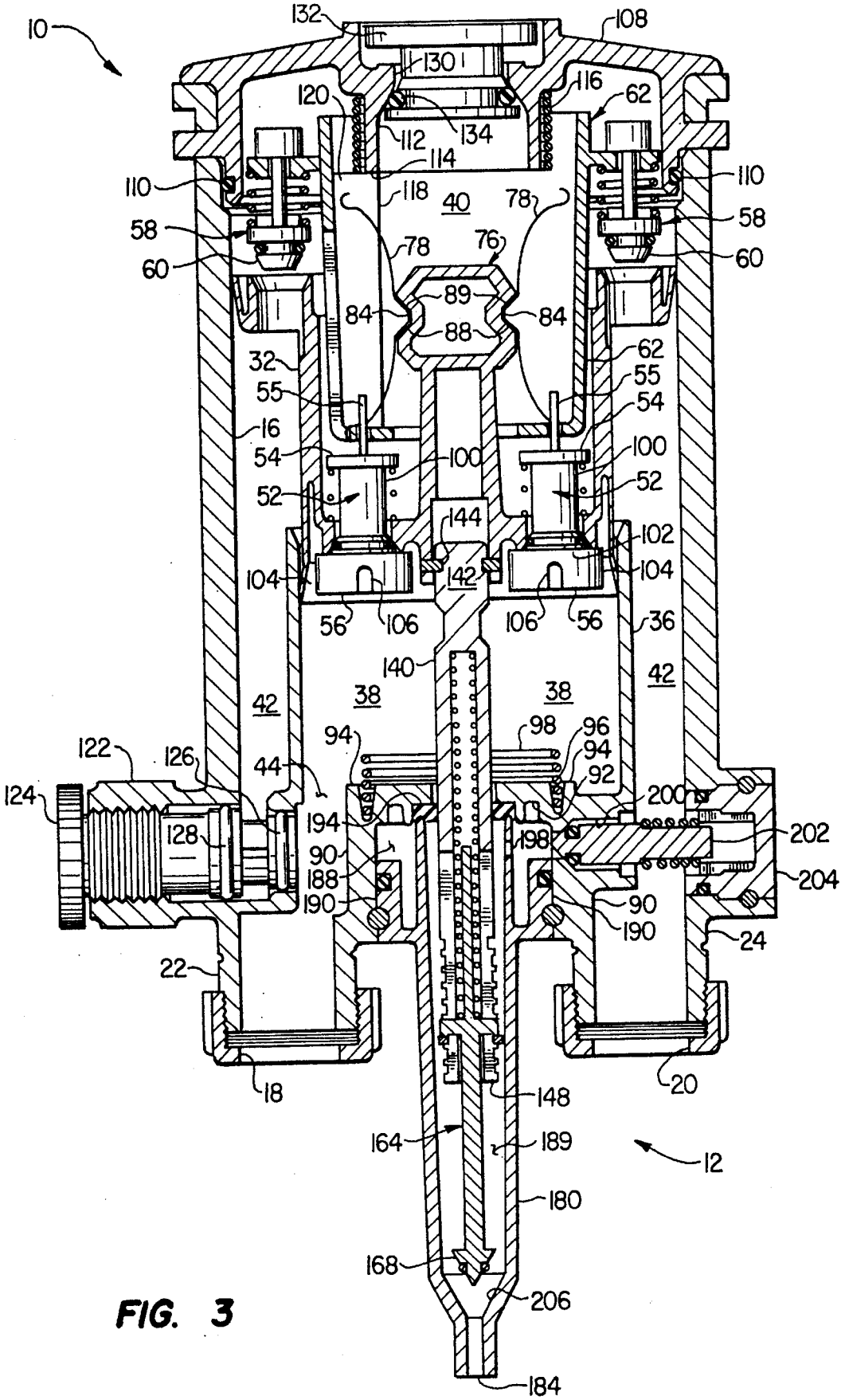
FIG. 3 is the same view as before with the piston now moved to near the top of its stroke with the valve positioner still in an alternate stable position and the inlet of the injection pump having been opened to draw secondary fluid within.

Referring now to FIG. 3 for clarity, it can be seen that the lower central portion of the housing between the bosses 22 and 24 has a circular wall 90 which extends in the longitudinal direction to a transverse wall 92 comprising a first stop member having a stop surface 94 and an actuating means. Annular groove 96 supports a circular bias element comprising a coil spring 98 mounted in groove 96. Spring 98 is an actuating spring which may be wedged or otherwise fixed in place in groove 96. First valve means 52 comprises one or more valve bodies 100 which operate from the smaller portion of the piston and extend into first variable chamber 38. Valve bodies 100 have a flat stem 55 which extends loosely through a flat opening in the bottom of valve positioner 62 to help maintain alignment of valve members 52 and increases their stability. Stem 55 prevents them from rotating.

Preferably, a plurality of valve bodies 100, each having a seal 102, close the openings 50 in the small face of the piston. Valve bodies 100 have a ring member 104 fixed to the valve bodies which projects below the openings 50. The ring members and valve bodies all shift together as a unit. Ring members 104 contain annular groove 106 adapted to receive and compress spring 98 as shown in FIG. 1 when the downwardly moving piston approaches first stop surface 94 of the first stop member. A force in aid of shifting is applied by fully compressed spring 98 to first valve means 52 but this force is less than the force required to initiate shifting of valve means 52 by movement of the valve positioner from the first alternate stable position. The holding force applied to valve positioner 62 by post 76 and leaf springs 78 exceeds the force applied to first valve means 52 by the fully compressed spring 98 until the force of the piston moves valve means 52 against stop surface 94 and thereby shifts or "preshifts" the valve positioner to the unstable intermediate position of FIG. 2 and cracks or unseats second valve means 58 to relieve or reduce the opposing force applied against valves 58 by the primary fluid pressure in second variable chamber 40. This is an important aspect of the present invention in that the full force applied to the closed face of the stepped piston is used to preshift the valve train by unseating or cracking the poppet valves, and only a comparatively small shifting force is then required to fully shift the valve set and thereby change the direction of reciprocation. Then compressed spring 98 is immediately able to shift valve means 52 and move the valve positioner to the second alternate stable position shown in FIG. 3.

Returning to FIG. 1, a removable cap 108 having a seal 110 is sealingly mounted in the top of housing 14. Cap 108 has a depending circular wall 112 which comprises a second stop member and second stop surface 114 having an associated actuating means. The second stop member is associated with a biasing element comprising a coil spring 116 positioned around depending wall 112. Spring 116 is an actuating spring. Cup-shaped body 154 of valve positioner 62 contains on the internal surface, one or more longitudinally positioned, radially extending ribs 118 comprising a stop surface 120 adapted to engage stop surface 114 as the piston nears the top dead center position of its stroke, as shown in FIG. 3. There are preferably a plurality of ribs 118 spaced around the inside peripheral surface of cup-shaped member 64, all of which serve to compress spring 116 and serve to engage the second stop member.

Finally, housing 14 has another boss 122 containing an adjustable plug 124 threaded therein which has a body which extends inwardly. Plug 124 has a seal 126 to seal an opening in wall 36 between first variable chamber 38 and third variable chamber 42. There is another seal 128 to seal the wall 16 to prevent leakage. Seal 128 continues to seal boss 122 when plug 124 is unscrewed to open a passage between chambers 38 and 42. When said opening in wall 36 is open, it creates a short circuit for the primary, fluid to pass directly from chamber 38 into chamber 42 without passing through the piston or chamber 40. It serves as a bypass which effectively stops the reciprocation of the piston by allowing the fluid to pass directly from the inlet 18 to outlet 20. Cap 108 which seals the top of the piston may contain opening 130 fitted with a button member 132 having a seal 134 to seal opening 130 when the unit is under pressure. It may be biased outwardly by a spring not shown. This can be useful to eliminate trapped air. By depressing button 132 briefly, any extraneous air that may be trapped in the housing is released so that it cannot interfere with the operation of the motor. It can also serve as a simple and effective bleed to neutralize retained pressure within the housing or aid in draining when the unit is disconnected.

In operation, the reciprocation of the motor will be described by reference to FIGS. 1–4. It will be assumed that inlet 18 and outlet 20 are connected to a conduit line containing pressurized primary fluid. In FIG. 1, second valve means 58 in the large face of the piston is closed and first valve means 52 in the small flee of the piston is open. Pressurized fluid flows upwardly from first variable chamber 38 through openings 50 which are larger in diameter than valve body 100 so that there is a fluid passage: through the opened small face of the piston. The pressurized fluid passes up through the center of the piston into the second variable chamber to the closed large face. The pressure applied to the closed large face is driving the piston downwardly. Valve positioner 62 is loading the second valve means via the poppet springs 72 under lateral extensions 68. The valve positioner is held in the first stable position by the interaction of the angled cam surfaces 86 with the angled cam surfaces of bight 84 of springs 78. Ring members 104 extending below first valve means 52 is already compressing spring 98 just prior to reaching the stop surface 94 of the first stop member.

FIG. 2 shows the position after the piston has moved downward from the position of FIG. 1. Spring 98 has been fully compressed by first valve means 52. Valve positioner 62 remains in the first alternate stable position of FIG. 1 until ring member 104 on the bottom of valve means 52 reaches stop surface 94 of the first stop member. As piston 26 continues to move downwardly, the full power of the moving piston is available to positively change the position of the valve train. The valve train comprises the valve positioner and a cooperating valve set operatively configured to axially shift together relative to the piston 26. A cam mechanism is provided by the detent on post 76 and the cam follower provided by bight 84 on spring 78 to hold the valve positioner in alternate stable positions. The upper poppet valves 58 are unseated or cracked when the valve train is thus moved to the intermediate unstable position partially opening the large face of the piston without closing the small face of the piston. There is no need to accumulate and release a large amount of energy in a compressed spring to effectuate reversing a valve means at the end of the stroke. The continued downward motion of piston 26 after valve means 52 is stopped at surface 94 causes the valve positioner to move or "preshift" to the intermediate unstable position shown in FIG. 2, which also cracks second valve means 58 to overcome the opposing pressure forces on valve means 58 to further shifting. Springs 78 are moved outwardly and bight 84 rises up the angled surface 86 of post 76 to a flat surface on land 87 between surfaces 86 and 88. Once the upper valve means 58 are unseated as the piston moves down a small distance further than the position shown in FIG. 2, there is significantly less resistance to further axial movement of the valve positioner relative to the piston. There is little or no stored shifting energy in springs 78.

Once a position slightly beyond the position of FIG. 2 is reached, valve positioner 62 cooperates with first valve means 52 and a relatively small shifting force provided by compressed coil spring 98 is immediately sufficient to shift the valve positioner and first and second valve means from the unstable position of FIG. 2 to the alternate stable position of FIG. 3. Bight 84 is then positioned in a circular "detent" like depression between angled surfaces 88 and 89 on post 76. Coincident with the shifting of the valve positioner and first valve means 52 in response to the action of spring 98, first valve means 52 is dosed and second valve means 58 is opened, thereby applying the operating fluid pressure against the closed small face of the piston to reverse the direction of reciprocation.

FIG. 3 shows the position of piston 26 after the piston has moved a considerable distance upwardly in the housing from the FIG. 2 position. There is preferably a small clearance between control surface 54 and the bottom of the fully shifted valve positioner 62 to insure that the valve positioner does not interfere with the full closing of the first valve means in response to a small poppet coil spring 101 around each valve body 100 which biases the valve means toward the closed position. Coil springs 101 merely insure that first valve means 52 goes to the closed position after the valve positioner is out of the way.

Figure 4:
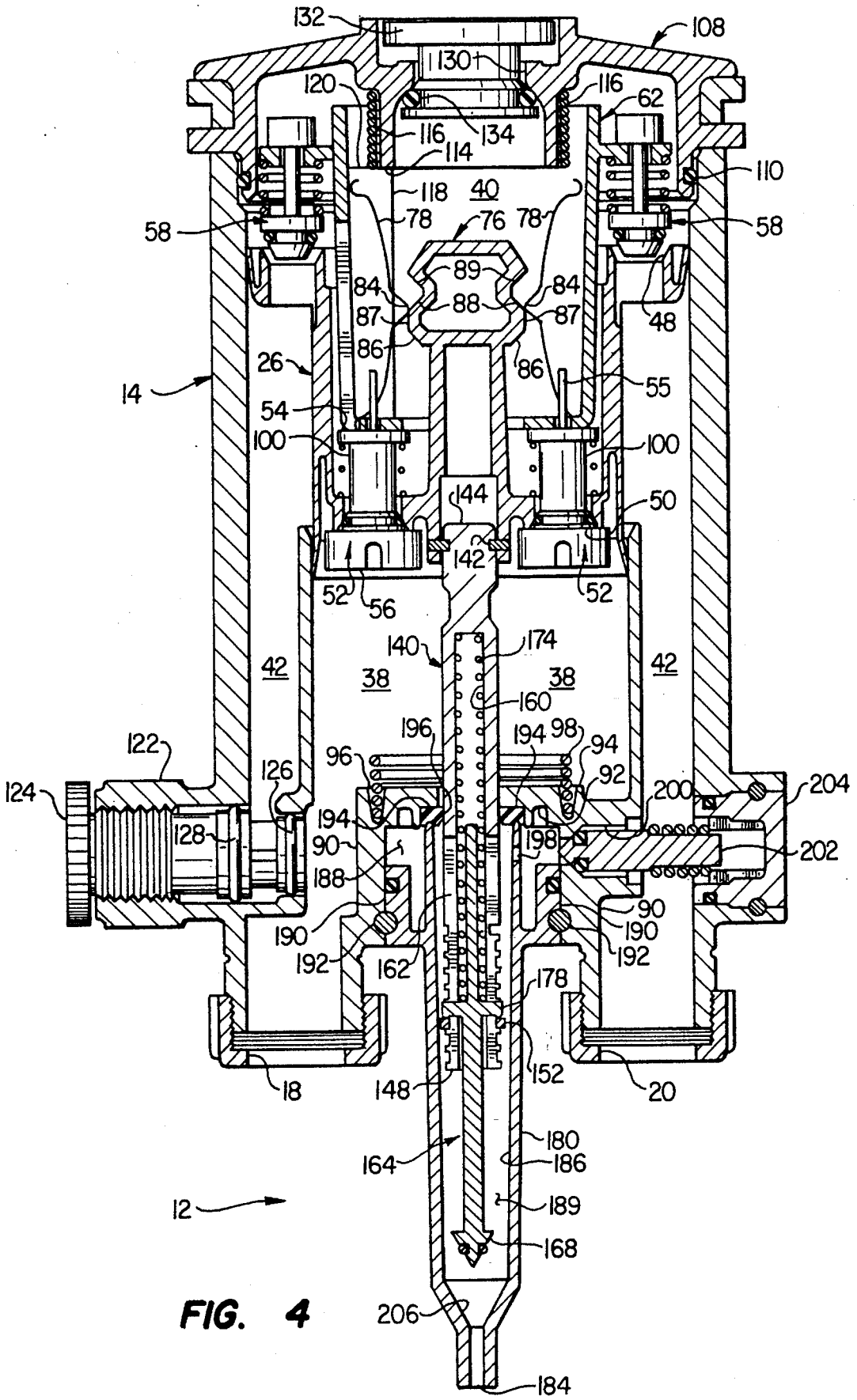
FIG. 4 is the same view with the piston near top dead center wherein the valve positioner has been moved from the alternate stable position to the intermediate unstable position just as the closed valves are being unseated and just before the upper biasing element shifts the valve positioner to the stable position shown in FIG. 1 thereby reversing the direction of reciprocation.

In FIG. 3, the upward movement of the valve positioner while in the second alternate stable position has compressed coil spring 116 associated with second stop member 112 without causing the valve positioner to shift relative to the piston. Stop surface 120 on the top of rib 118 has come in contact with the second stop member 112 at stop surface 114 prior to any shifting of the valve positioner. Now the full force of the pressure applied to the closed small face of the piston is available to drive the piston relative to the valve positioner, causing the piston to move or "preshift" the bight of spring 84 from the second alternate stable position of FIG. 3 once again to the intermediate unstable position, as illustrated in FIG. 4, just before a further small axial movement cracks valve means 52 and unseats the valve members 52 partially opening the small face of the piston without also closing the large face of the piston.

Once the point of bight 84 reaches the flat surface of land 87 on the post between angled surfaces 88 and 86, and the lower poppet valves are unseated, it is in the unstable intermediate position and very little additional force is required to cause axial movement to the first alternate stable position which was shown in FIG. 1. This additional force is provided by a shifting force applied to valve positioner 62 by spring 116 and is applied against the one or more longitudinally extending ribs 118. The shifting force applied by spring 116 is not sufficient to shift the valve positioner from the stable position to the intermediate unstable position, but once the valve positioner reaches the intermediate unstable position, this force immediately drives the bottom of the valve positioner against the internal control surface 54 of the first valve means which simultaneously fully opens first valve means 52 and closes second valve means 58. Since the small face of the piston is now open and the large face of the piston is now closed, the pressurized fluid passes upwardly through openings 50 to reach the closed large face thus immediately reversing the direction of reciprocation of piston 26. This returns the assembly to the condition of FIG. 1 and the piston moves downwardly to repeat the cycle unendingly. The valve positioner is held by the cc operating springs 78 and post 76 with a force that is greater than the force provided by either of the actuating coil springs 98 or 116 so that they can be fully compressed without causing any shifting. It is not until the force of the piston itself drives the valve positioner against the stop members and cracks or unseats the valves in the closed face of the piston, that relative shifting movement of the valve positioner in response to the shifting force applied by the actuating means, springs 98, 116 can occur.

An improved injection pump is couple t to the bottom of piston 26 for reciprocation therewith. Referring to FIG. 4, the pump mechanism comprises an elongated body 140 having a back end 142 coupled to the bottom of the piston wail with one or more keys 144. The circular end 142 of elongated body 140 may be centered in a blind hole in the bottom of post 76 of the piston.

Figure 5:
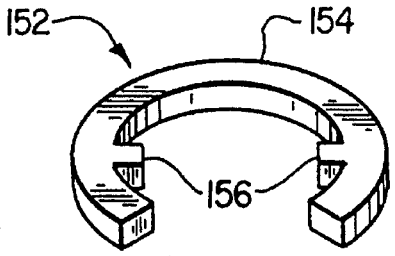
FIG. 5 is a perspective view of a keeper which is carried in a selected one of a plurality of spaced apart grooves on the injection pump mechanism.
Figure 7:
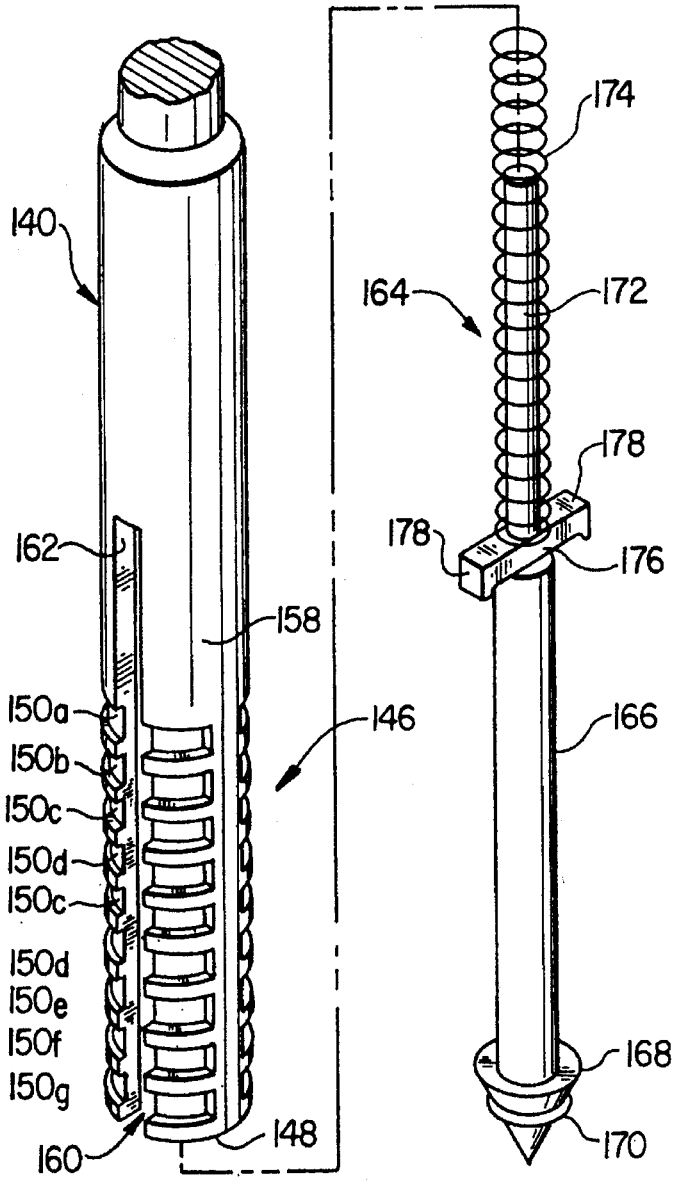
FIG. 7 is a perspective view of the-elongated body and sliding valve member assembly which comprises the pump mechanism.

Referring now to FIG. 7, we see in cut-away view the front end of elongated body 140 having a front end portion 146 having a front end 148 and a plurality of transversely oriented keeper grooves 150*a*–150*g*. Keeper grooves 150 are spaced apart along the front end portion 146. Grooves 150 are adapted to receive and hold an easily removable keeper 152 shown in FIG. 5. Keeper 152 has a partial circular body 154 shaped like a cut-away washer having a pair of opposed radial lugs 156 projecting from an interior surface of keeper 152. Elongated body 140 has a longitudinally extending wail 158 forming a hollow interior 160. A pair of opposed longitudinally extending slots 162 are formed in wail 158 extending along front end portion 146.

Still referring to FIG. 7, a sliding valve member 164 is fitted within opening 160 to extend from front 148. Sliding valve member 164 has a valve carrier member 166 and a tapered valve 168 equipped with a seal 170. A rearwardly extending tang 172 supports an elongated coil spring 174 and is provided with a transversely oriented bar 176 having opposed tabs 178 located between carder member 166 and tang 172.

Figure 6:
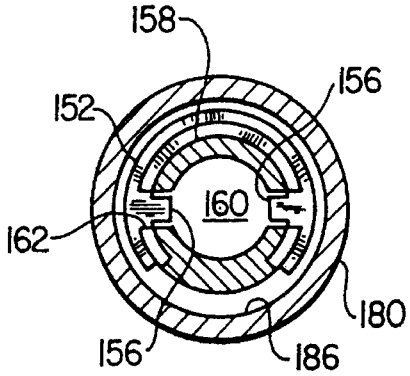
FIG. 6 is a cross-section of the injection pump on the lines 6—6 of FIG. 1.
Figure 8:
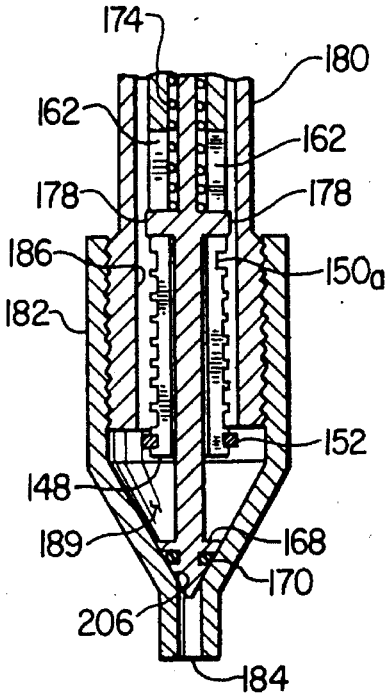
FIG. 8 is a cut-away longitudinal central cross-section of the lower end portion of the injection pump showing the keeper of FIG. 5 in a position different from the position shown in the other figures.

With reference to FIGS. 6, 7 and 8, sliding valve member 164 is fitted into the opening 160 in sliding relation therewith. Tabs 178 are positioned in slots 162 and comprise cooperating slots and tabs to selectively control the amount of extension of valve 168 from body 140 when keeper 152 is positioned in a selected one of the grooves 150*a–g*. The whole assembly is fitted in a pump casing 180. As indicated in FIG. 8, an end cap 182 may be fastened on the lower end of casing 180 to provide a tapered valve seat 206 for valve 168 and an inlet 184 for secondary fluid to be added to the primary fluid. Casing 180 has a cylindrical surface 186 which forms a hollow space 189 which is a pump chamber for the operation of injection pump 12. The sliding valve member is omitted in FIG. 6 for clarity.

Returning again to FIG. 4, wall 90 may be referred to as an outer wall in housing 14 which may be said to form a well in the outer wall in which pump casing 180 is sealingly mounted to form an outlet chamber 188 in the well when pump casing 180 is removably attached to the motor housing by means of a quick-connect and disconnect device. Pump casing 180 includes a peripheral wall 190 which fits against the inner surface of outer wall 90 of the housing along a sliding interface sealed with an "O" ring. Where outer wall 90 and peripheral wall 190 come together in a location below the seal, a relief area is provided for a U-shaped wire member 192 which slides transversely into the relief area (transverse openings) between walls 90 and 190 to removably hold pump casing 180 in position.

The open upper end of pump casing 180 is held against a resilient seal 194 fitted transversely on the underside of wall 92. Seal 194 has an opening 196 through which body 140 slidingly reciprocates in sealed contact. Thus, seal 194 simultaneously seals the open upper end of casing 180 while at the same time sealing the pump mechanism which extends through an opening in wall 92 in sealed contact with seal 194 at opening 196.

The upper end portion of casing 180 includes opening 198 in fluid communication with outlet chamber 188 for delivery of secondary fluid through passageway 200 leading to outlet 20. Passageway 200 has a sealing surface in contact with a spring-loaded one-way flow valve 202 mounted in the wall of the housing to control the flow of fluid from chamber 188 to outlet 20. One-way flow valve 202 prevents primary fluid from entering chamber 188 but permits secondary fluid in chamber 188 to mix dining the pumping stroke with the primary fluid between chamber 42 and outlet 20 for use downstream. An easily removable plug member 204 is sealingly fitted into the side wall of the housing to support the biasing spring of one-way valve 202 and permit ready access to the valve for maintenance purposes. Quite importantly, it can be seen that the secondary fluid has a separate pathway to follow to outlet 20 which does not pass through the reciprocating piston in the housing of the pump motor. Since the secondary fluid often contains abrasive or corrosive material, this separate path greatly reduces wear and maintenance of the reciprocating motor.

Figure 9:
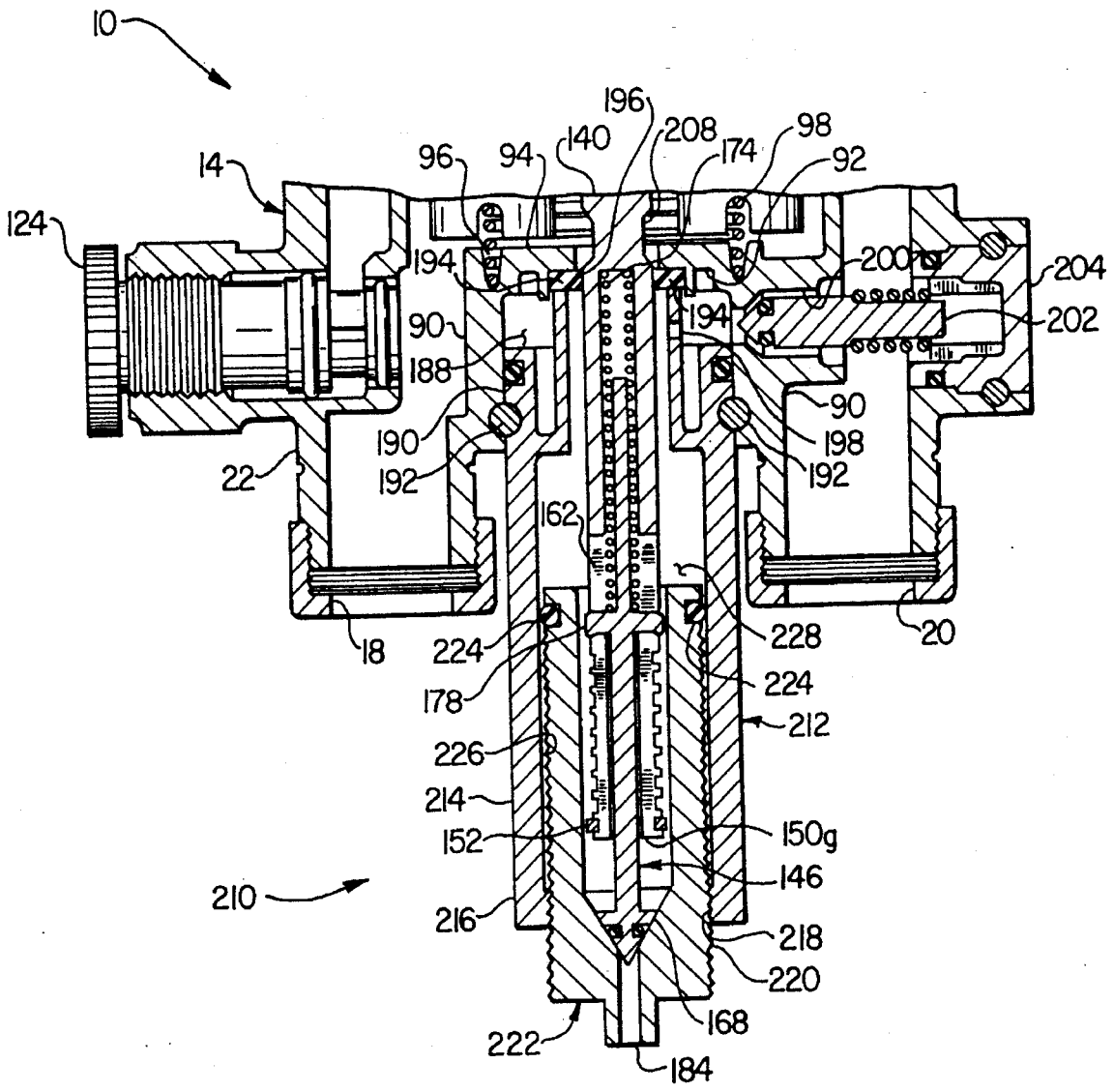
FIG. 9 is a cut-away longitudinal central cross-section of an alternate injection pump which has an enlarged pump casing and an adjustable insert which alters pump capacity.

An alternate injection pump 210 which fits into the well of the housing is adjustable by a different mechanism which is disclosed in FIG. 9. An injection pump 210 has a modified pump casing 212 which has an upper end like the upper end of pump casing 180, but the lower end is much larger is diameter created by bringing peripheral wall 190 straight down as wall 214. Wall 214 has a threaded bottom portion 216 equipped with internal threads 218 which engage the threaded outer surface 220 of an adjustable insert 222 having the opening 184 for secondary fluid. The upper end of insert 222 is equipped with a seal 224 which sealingly engages the inner wall surface 226 and prevents fluid from escaping the pump chamber 228.

FIG. 9 shows that the upper end of casing 212 and the internal portions of the pump, although shown slightly reduced in scale, are otherwise essentially identical to pump 12. The circular wall 90 of housing 14 is formed to include an inner surface in seating contact with peripheral wall 190, by means of a "O"-ring seal and held in place by quick release connector 192 as described before. Pump casing 212 includes an upwardly extending portion in sealed contact with seal 194 and an opening 198 for release of secondary fluid into pump chamber 188 where it can pass into outlet 20 through passageway 200 when one way flow valve 202 is forced open as shown in FIG. 9. Elongated body 140 is fitted into the piston to move therewith. The lower end of insert 222 forms a tapered seal for tapered valve 168 at the lower end of valve carrier member 146. In this case keeper 152 is placed in the lowest keeper groove 150*g* and left there because it need not be used to adjust the displacement of pump 210. Rather, the displacement of pump 210 depends upon the respective longitudinal position of the insert 222 and the pump casing 212. If the insert 222 is screwed further up into the pump casing 212, the amount of displaced fluid is one pump cycle is reduced because the secondary fluid inlet is closed earlier than it would be otherwise. The larger diameter of the downwardly extending portion of pump casing 212 provides additional room to employ a larger diameter elongated body 140 which can increase the displacement of pump 210 if the larger diameter portion of elongated body 140 is limited to the area which travels up and down below seal 194 or the seal 194 can be opened up to maintain sealing contact with a larger diameter elongated body 140. In addition, almost infinite adjustment of the ratio is possible by means of the threaded insert 222.

The operation of the injection pump bay now be described with respect to FIGS. 1 through 4. Outlet 184 is connected to a source of secondary fluid containing an additive to be added to the primary fluid flowing through the motor housing. Elongated body 140 which is fastened at back end 142 to the bottom of the piston is movable with the piston to an extended position at the bottom of the reciprocation and a retracted position at the top of the reciprocation. The elongated body displaces a volume of fluid in pump chamber 189 in pump casing 180 as it moves from the retracted to the extended position. Sliding valve member 164 extends from the front 148 of elongated body 140 to cause valve member 168 to cooperate with sealing surface 206 near inlet 184 of the casing to open and close pump chamber 189 as the elongated body moves between the extended and the retracted position. Sliding valve member 164 is biased by the action of spring 174 in opening 160 to extend outwardly from front 148 of elongated body 140.

A selective adjustment mechanism associated with the elongated body fixes the amount of maximum extension of the sliding valve member to establish the remaining volume in pump chamber 189 when valve member 168 seals inlet 184 as elongated body 140 moves toward the extended position to cause displacement of a selected amount of secondary fluid from pump chamber 189 through passage 198 leading to outlet chamber 188. Pressure of the displaced fluid in chamber 188 opens one-way valve 202 so that secondary fluid flows through passage 200 into outlet 20 where it mixes with primary fluid. The amount of maximum extension is selectively set by placement of keeper 152 at a selected keeper groove in cooperation with tabs 178. Keeper lugs 156 engage tabs 178 to limit extension of the sliding valve member.

Proceeding from the retracted position of FIG. 4, as the piston moves down, the pump mechanism comprising elongated body 140 and sliding valve member 164 are fed into pump chamber 189 through seal 194 to displace an equivalent volume of secondary fluid from the pump casing. Since valve member 168 has not yet closed, the secondary fluid is expelled from pump chamber 189 through outlet 184 back into the secondary fluid reservoir. As the piston and pump continue to move down, a point is reached where valve 168 closes outlet 184. The place in the cycle where this occurs is selectively controlled by placement of keeper 152 in one of the keeper grooves 150. The greater the extension of valve 168 from front 148 of elongated body 140, the larger amount of secondary fluid will be displaced with each pump stroke. If keeper 152 is placed high, such as in keeper groove **150*a*, a much greater quantity of fluid will be expelled from pump chamber 189 before the chamber is closed by valve 168**.

This is a positive displacement fluid pump which is precisely and accurately controlled by the placement of keeper 152. Since the keeper grooves are uniformly spaced in a longitudinal direction, the output of the pump is precisely controlled for each stroke of the pump and may be pre-calibrated to produce a given ratio of secondary fluid to primary fluid with a range of approximately an order of magnitude or more. A typical range of secondary fluid to primary fluid may be 0.1% to 1.0%. By identifying the particular keeper groove in which keeper 152 is placed, this ratio is instantly known. A greater ratio of up to 5% secondary fluid to primary fluid is obtainable with a suitably sized injection pump of the alternate embodiment.

Once valve 168 is closed, the continued extension of valve body 140 raises the pressure in chamber 189 to force secondary fluid through opening 198 in casing 180 into outlet chamber 188. The pressure in chamber 188 unseats one-way flow valve 202 and the secondary fluid mixes with the primary fluid in chamber 42 and flows on into the outlet 20. Body 140 is pushed down over sliding valve member 164 which is held by contact with inlet 184.

FIG. 2 represents the maximum extension of elongated body 140 at the bottom of the piston stroke. Injection pump 12 is an automatically self priming pump. It will be noted that there is a reduced diameter neck portion 208 formed in elongated body 140 just ahead of back portion 142. This neck portion 208 is longitudinally spaced so that the sliding seal between elongated body 140 and opening 196 is released just as the pump reaches the bottom of a stroke. This equalizes the pressure between pump chamber 189 and first variable chamber 38, allows primary fluid from chamber 38 to fill pump chamber 189 and allows any trapped air bubbles to float up out of chamber 189. As soon as the elongated pump body begins to move up again, this seal is immediately reinstituted as shown in FIG. 1. Pump 12 is automatically primed at startup and kept primed with primary fluid even if the pump casing is empty at start-up or the supply of secondary fluid is temporarily interrupted.

As the piston moves up the position of FIG. 1 to the position of FIG. 3, a suction is created within chamber 189 by the withdrawal of the pump mechanism from casing 180. This suction may be strong enough to lift valve 168 away from seat 206 to allow the secondary fluid to enter pump chamber 189 as the valve body moves up even before valve 168 is lifted away from the seat. Once valve 168 is lifted by body 140, continued retraction draws the secondary fluid through inlet 184 refilling pump chamber 189. On the downstroke the conical shaped valve member remains sealed because it is subjected to pressure from above. It should be noted in this regard that spring 174 which biases the sliding valve member outwardly is a relatively weak spring just sufficient to insure that the sliding valve member can return to the maximum position established by the location of keeper 152. At some point during the upward movement, the sliding valve member is fully extended resting against keeper 152 and withdrawn away from inlet 184. The cycle is now ready to repeat when the piston comes back down.

In the best mode, the motor and pump parts are preferably molded from a stable chemically resistant plastic except for the springs and seals which should be selected to last in the chemical environment expected. Seals are preferably "O" rings made of a fluorinated polycarbon material commonly sold under the trademark VITON for high chemical resistance. The post may be molded from a polymer sold under the trademark DELRIN to provide good wear resistance. In one embodiment, the parts are size to inject about 300 ml with each pump stroke and should operate at about 5 to 100 pounds per square inch line pressure. The reciprocation of the motor and the pump output is entirely proportional to flow volume of primary fluid and essentially independent of line pressure. Actuating springs above and below the piston exert a force when compressed of about 6 pounds, a force sufficient to reliably shift the valve members and valve positioner once the poppet valves of the closed face of the piston are cracked partially open. It is believed that the resisting or opposing force on the valve means which are closing the then closed face of the piston are significantly reduced when these popper valves are cracked or unseated about 1/32" to 1/16" from the valve seat. This shifting force compares, for example, to a force of about 18 pounds required to compress the shifting springs in the device disclosed in U.S. Pat. No. 5,137,435 which is necessary to open the popper valves and shift the mechanism. Wear and damage caused by hammering the structure with 18 pounds of force each time the valves shift is greatly reduced in the direction action design of the present invention, and it runs more quietly as a result.

I claim:

1. A fluid pressure operated motor for quietly reciprocating a fluid injection pump to inject predetermined quantities of a secondary fluid into a primary fluid stream, comprising:

a housing having primary fluid inlet and outlet for pressurized primary fluid;

a stepped piston having a large face and a smaller face, mounted for reciprocation in said housing and separating the interior into at least first and second variable chambers;

operatively connected first and second valve means carried with the stepped piston, being shiftable for establishing a stroke cycle of said piston by alternately closing one face of the piston and at the same time opening the other of said piston faces to pressurized fluid, including a shiftable valve positioner carried by the stepped piston and shiftable between alternate stable positions and an intermediate unstable position to operate said first and second valve means wherein one of said piston faces is closed while the other of said piston faces is open at each of the alternate stable positions of the valve positioner;

stop members placed on opposite sides of the piston and positioned to positively stop the valve positioner from further movement in a given direction of reciprocation while the piston continues moving in response to pressure of primary fluid on the closed face of the piston thereby preshifting the valve positioner and said valve means relative to the piston from one alternate stable position to the intermediate unstable position and partially opening the closed face of the piston;

actuating means associated with each of the stop members and positioned to resiliently apply a shifting force to the valve positioner as the piston approaches the end of the stroke in a given direction, said shifting force not being sufficient to move the valve positioner from an alternate stable position until one of said stop members stops the valve positioner while the piston is still moving and thereby causes the valve positioner and said valve means to preshift to the intermediate unstable position whereupon the valve positioner and the operatively connected first and second valve means are immediately shifted from the intermediate unstable position to the other alternate stable position in response to the said shifting force applied by said actuating means thereby closing the face of the piston that was open and opening the face of the piston that was closed, to reverse the direction of reciprocation of the piston;

whereby the full force applied to the closed face of the stepped piston is available to preshift the valve means to an unstable position and only a comparatively small shifting force is then required to fully shift the valve positioner and the valve means to a stable position to thereby change the direction of reciprocation of the motor.

2. The combination of claim 1 further including an injection pump for secondary fluid coupled to the fluid motor for reciprocation therewith.

3. The combination of claim 1 including cams on one of the piston or valve positioner and a cooperating cam follower on the other of the piston or valve positioner which are configured to hold the valve positioner in either of the alternate stable positions in opposition to said shifting force.

4. The combination of claim 3 wherein said cams comprise cam surfaces separated by a land and said preshifting movement is accompanied by movement of said cam follower along one of said cam surfaces to said lined.

5. The combination of claim 4 wherein the piston contains a post in which said cam surfaces are formed, said cam follower being mounted to move with the valve positioner and biased to engage the cam surfaces in said posts.

6. The combination of claim 1 wherein said valve positioner is a cup shaped member slidingly mounted for axial movement within the piston, having a bottom positioned to open the first valve means mounted in the smaller face of the piston in a first of the alternate stable positions.

7. The combination of claim 6 wherein said stop members comprise a first stop member positioned in the first variable chamber and a second stop member positioned in the second variable chamber, said first valve means being interposed between the valve positioner and the first stop member.

8. The combination of claim 1 wherein one of the piston or valve positioner has cam surfaces and the other of the piston or valve positioner has a biased cam follower adapted to follow said cam surfaces to establish the two alternate stable positions of the valve positioner with respect to the piston.

9. The combination of claim 8 further including an injection pump for secondary fluid coupled to the fluid motor for reciprocation therewith.

10. The combination of claim 8 wherein said cam surfaces are axially displaced in the direction of reciprocation and separated by a laterally extending land which creates said intermediate unstable position when preshifting o f the valve positioner that is caused by a stop member forces the cam follower to move from one of said cam surfaces to said land.

11. A fluid pressure operated motor for quietly reciprocating a fluid injection pump to inject predetermined quantities of a secondary fluid into a primary fluid stream, comprising:

a housing having interior walls and an inlet and outlet for connection in fluid communication with pressurized primary fluid in an operating fluid line;

a stepped piston mounted for reciprocation in the housing, said stepped piston having a larger diameter portion with a large face, and a smaller diameter portion with a smaller face in sliding sealed contact with said interior walls, said smaller face dividing the interior of the housing into a first variable chamber below the face and a second variable chamber above the face;

a first passageway leading from the inlet to the first variable chamber and a second passageway leading from the second variable chamber to the outlet whereby operating fluid under pressure can traverse the housing by moving in a controlled path through the first and second chamber;

a valve train carried by the piston comprising a valve positioner and a cooperating valve set operatively configured to axially shift together relative to the piston between alternate stable positions and an intermediate unstable position, the valve train including a holding mechanism which applies a holding force to the valve positioner which resists movement from an alternate stable position to the intermediate unstable position;

said valve set comprising first valve means to open and close the smaller face of the piston and a second valve means to open and close the large face of the piston, said valve set being shiftable together with the valve positioner to alternately close one of said piston faces while opening the other of said piston faces at each of the alternate stable positions of the valve train;

actuating means in the housing for applying a shifting force to the valve train, said shifting force being less than the force required to shift the valve train against the pressure force on the closed first or second valve means caused by the pressurized fluid in the housing;

a first stop means positioned to stop the valve train as the piston is moving in one direction of reciprocation and second stop means positioned to stop the valve train as the piston is moving in the other direction of reciprocation, thereby preshifting the valve train to the intermediate unstable position and partially opening the closed face of the piston by unseating one of the first or second valve means until said shifting force exceeds the remaining pressure force on the unseated first or second valve means, whereupon the valve train immediately moves to an alternate stable position in response to the shifting force applied to the valve train by said actuating means, thereby closing the face of the piston that was open and fully opening the face of the piston that was partially open in response to unseating one of the first or second valve means;

whereby the full force applied by the pressurized fluid to the closed face of the piston is used to preshift the valve train to reduce the pressure force on the closed valve means so that only a comparatively small shifting force is required to fully shift the valve positioner and valve set to reverse the direction of reciprocation.

12. The combination of claim 11 further including an injection pump for secondary fluid coupled to the fluid motor for reciprocation therewith.

13. The combination of claim 11 wherein said actuating means comprises biasing elements associated with said stop members whereby said shifting force is alternately applied to the valve train by one of said biasing elements to shift the valve train when the valve positioner reaches its intermediate unstable position.

14. The combination of claim 13 wherein said first valve means comprises a valve body which operates from the smaller portion of the piston and extends into the first variable chamber.

15. The combination of claim 14 wherein said valve body contains a groove to receive a biasing element when said piston approaches the first stop means, whereby said shifting force is applied.

16. The combination of claim 15 wherein the first stop means comprises a wall of the housing generally transverse to the direction of reciprocation.

17. The combination of claim 16 wherein the first stop means comprising said wall of the housing has a groove and one of said biasing elements is mounted in said groove.

18. The combination of claim 11 wherein the valve positioner is a cup shaped member slidingly mounted for axial movement partially within the smaller diameter portion of the piston, extending into the second variable chamber.

19. The combination of claim 18 wherein the second valve means comprises at least one valve member mounted on the valve positioner.

20. The combination of claim 19 wherein the housing contains an opening sealed with an openable valve to serve as an air bleed in order to aid starting by removing extraneous air bubbles.

21. The combination of claim 11 wherein said holding mechanism which holds the valve train in the alternate stable positions comprises a cooperating spring and detent combination positioned within the piston.

22. The combination of claim 21 wherein the center portion of the piston is equipped with a post containing said detent and the valve positioner has a spring element which cooperates with said detent to establish the alternate stable positions of the valve positioner.

23. The combination of claim 22 wherein said first stop means is positioned in the first variable chamber and said first valve means is interposed between the valve positioner and the first stop means.

24. The combination of claim 23 wherein said second stop means is positioned in the second variable chamber and stops said valve train by stopping said valve positioner at one end of the piston stroke.

25. A fluid pressure operated motor for reciprocating a fluid injection pump to inject predetermined quantities of a secondary fluid into a primary fluid stream, comprising:

a housing having axially arranged internal cylinder walls for slidingly engaging the different diameters of a stepped piston having a large diameter face and a smaller diameter face;

a stepped piston body in the housing having opposed large and smaller diameter step faces with at least one fluid opening in each face communicating through the piston body;

an inlet passage in said housing for conducting primary fluid under pressure from an inlet to one of the step faces of the piston;

an outlet passage in said housing for conducting primary fluid under pressure from the other one of the step faces of the piston to an outlet in the housing;

stop members positioned in the housing above and below the stepped piston and biasing elements associated with the stop members;

opposed valve means mounted for movement with the piston for closing said at least one fluid opening in one face of the stepped piston while opening said at least one fluid opening in the other of said faces;

a valve positioner mounted for reciprocation with the piston and for movement relative to the piston between alternate stable positions and an intermediate unstable position, the valve positioner cooperating with said opposed valve means to alternately open one step face of the piston while simultaneously closing the other step face of the piston thereby changing the direction of reciprocation;

a shifting force being applied alternately to the valve positioner by compression of one of said biasing elements as the piston approaches each end of its stroke, said shifting force being less than the force needed to shift the valve positioner from one of its alternate stable positions to said intermediate unstable position but greater than the force needed to shift the valve positioner from its unstable position to the next of said alternate stable positions;

said opposed valve means comprising a second valve means mounted on the valve positioner and a first valve means mounted on one step face of the piston and extending therefrom toward a stop member, said first valve means and said valve positioner being aligned and configured to move as a unit in response to the valve positioner being stopped by a stop member near one end of the piston stroke or the first valve means being stopped by a stop member near the other end of the piston stroke, while the piston is moving in a given direction of reciprocation;

the valve positioner being stopped alternately by a stop member or a stop member and the first valve means near each end of the piston stroke while the piston continues moving in a given direction, thereby causing relative movement between the valve positioner and the piston and moving the valve positioner from one alternate stable position to said intermediate unstable position and causing the closed face of the piston to partially open by substantially simultaneously unseating one of said first or second valve means as the intermediate unstable position is reached;

whereupon the shifting force applied by the compression of a biasing element is sufficient to move the valve positioner to the next alternate stable position and shift the opposed valve means to reverse the reciprocating direction of the piston whereby the full power of the moving piston is available to positively change the position of the opposed valves without the necessity of accumulating and releasing a large amount of energy in a compressed spring to effectuate reversing the opposed valve means at the end of the stroke.

26. The combination of claim 25 characterized in that said first valve means comprises a plurality of valve bodies extending away from a step face of the piston into a variable chamber.

27. The combination of claim 26 characterized in that a portion of the wall of the housing partially defining said variable chamber is configured as one of the stop members.

28. The combination of claim 27 characterized in that said wall contains a groove containing one of said biasing elements facing said valve bodies and said valve bodies have a corresponding groove to receive said one biasing element whereby said shifting force is applied to said first valve means through said one biasing element as said first valve means approaches said wall near the end of a stroke.

29. The combination of claim 25 characterized in that the stable position of the valve positioner is established by a cooperating spring and detent combination positioned within the piston and forcefully engaged to hold the valve positioner in one of two said alternate stable positions.

30. The combination of claim 29 characterized in that the center portion of the piston is equipped with a post containing said detent and the valve positioner has a spring element which forcefully cooperates with said detent to establish the alternate stable positions of the valve positioner and an intermediate unstable position between said stable positions.

31. The combination of claim 30 characterized in that said valve positioner is cup-shaped member slidingly mounted for axial movement within the piston and laterally positioned with respect to said post.

32. The combination of claim 31 characterized in that the housing includes an external valve which selectively connects the inlet passage with the outlet passage in a manner that permits flow between the inlet and the outlet without passing through the stepped piston thereby equalizing pressure and stopping the piston from reciprocating.

33. The combination of claim 32 characterized in that said valve member mounted in the external wall is adjustable to selectively introduce varying amounts of inlet fluid to the outlet fluid chamber as a means of adjusting the speed of reciprocation of the given line pressure.

34. In a device for injecting predetermined quantifies of a secondary fluid into a primary fluid stream carried under pressure in a line, a motor housing connected in said line comprising a fluid motor having a stepped piston having stepped faces with a valve assembly and a valve shifting mechanism for shifting the valve assembly to apply line pressure alternately to the stepped faces of the piston thereby causing reciprocation of the piston in the housing, the housing having an inlet and an outlet for the primary fluid, a pump casing having an inlet for a secondary fluid mounted in sealed contact with the housing, the pump casing having a pump chamber and a pump mechanism therein connected to the stepped piston for reciprocation therewith, characterized in that:

the pump mechanism comprises an elongated body having a back end connected to said piston and a front end disposed in the pump chamber, the elongated body being movable with the piston to an extended position at the bottom of the reciprocation and a retracted position at the top of the reciprocation, the elongated body displacing a volume of fluid in the pump chamber as it moves from the retracted to the extended position;

a sliding valve member extending from the front of the elongated body which cooperates with a sealing surface at the inlet of the casing to open and close the pump chamber as said elongated body moves between the extended and retracted position;

a selective adjustment mechanism associated with the elongated body which fixes the amount of maximum extension from the elongate body of the sliding valve member to establish the remaining volume in the pump chamber when the valve member seals the inlet as said elongated body moves toward the extended position to cause displacement of a selective amount secondary fluid from the pump chamber through a passage leading to the primary fluid line.

35. The combination of claim 34 characterized in that the sliding valve member is biased to an extended position from the front of the elongated body wherein said extended position is controlled by the selective adjustment mechanism to cause the sliding valve member to seal the pump chamber when the front end of the elongated body is at one of a plurality of distances from the inlet, to selectively vary the amount of fluid displaced during one cycle.

36. The combination of claim 35 characterized in that the casing has an outlet chamber with a passage leading to the outlet side of the fluid motor to receive secondary fluid displaced from the pump chamber and a one way valve controlling outflow of secondary fluid from the outlet chamber into the primary fluid of the outlet side of the fluid motor.

37. The combination of claim 35 characterized in that the motor housing has a wall through which the elongated body sealingly reciprocates, said wall having an internal surface facing the stepped piston, an external surface facing the pump casing and sidewalls in which the pump casing is mounted removably for readjustment of the selective adjustment mechanism to alter the amount of displacement of secondary fluid from the pump chamber.

38. The combination of claim 37 characterized in that the valve assembly of the stepped piston has one or more valves in one of the stepped faces that extend toward the internal surface of said wall, wherein said internal surface serves as a stop for said one or more valves near the end of the reciprocation of the piston to positively shift the valve assembly of the stepped piston thereby reversing the direction of reciprocation of the piston and pump mechanism.

39. The combination of claim 38 characterized in that the internal surface of said wall has a biasing element adapted to encounter said one or more valves in one of the stepped faces of said piston near the end of the reciprocation before said one or more valves reach the stop, to cushion said one or more valves mid provide some shifting force to aid in shifting the valve assembly to reverse the reciprocation.

40. The combination of claim 36 characterized in that said motor housing has an outer wall and a well in said outer wall through which said elongated body reciprocates, said pump casing being sealingly mounted in said well to form said outlet chamber in said well for secondary fluid.

41. The combination of claim 40 characterized in that said pump casing includes a peripheral wall which sealingly engages said well when the pump casing is removably attached to said motor housing and a quick connect and disconnect device removably attaching said pump casing to said motor housing.

42. The combination of claim 34 characterized in that the elongated body has an opening at the front end and a hollow interior and the sliding valve member is partially disposed in the hollow interior for extension and retraction relative to the elongated body.

43. The combination of claim 42 characterized in that the elongated body and sliding valve member have cooperating slots and tabs positioned in the slots and a selectively movable keeper that comprise the selective adjustment mechanism.

44. The combination of claim 42 characterized in that the hollow interior of said elongated body has a hollow spring chamber and a compressible spring therein which biases said sliding valve member to the extended position of the sliding valve member.

45. The combination of claim 44 characterized in that the elongated body has said slots comprising longitudinal slots and said sliding valve member has said tabs comprising lateral tabs which slide in the longitudinal slots of said body.

46. The combination of claim 45 characterized in that said elongated body includes a plurality of lateral keeper grooves which cooperate with said keeper to selectively limit the amount of extension of said sliding valve member from said elongated body.

47. The combination of claim 46 characterized in that said keeper extends into the longitudinal slots and engages said lateral tabs to limit the extension of the sliding valve member.

48. A method of operating a reciprocating fluid powered motor of the type having a housing installed in a pressurized primary fluid line, a stepped piston having a large and small face slidingly mounted for reciprocation in the housing, an upper valve means to close the large face, a lower valve means to close the small face, valve positioner shiftable with respect to the piston to operate the upper valve means and substantially simultaneously operate the lower valve means to change the direction of reciprocation of the piston in response to pressurized primary fluid applied to a closed face of the piston, the method comprising the steps of:

providing lower valve means having a valve body which traverses the small face of the piston, having a closing surface without the piston and an opposite opening surface within the piston located to move with the valve positioner;

providing stop means in the housing above and below the piston, placed to limit travel of the valve positioner on the upstroke of the piston and limit travel of the lower valve means on the downstroke of the piston;

applying pressurized fluid to the closed small face of the piston causing the piston to move upwardly in the housing;

closing the upper valve means and opening the lower valve means by bringing the valve positioner against a stop means while the piston is moving upwardly, to reverse direction of reciprocation;

applying pressurized fluid to the close upper face of the piston causing the piston to move downwardly;

stopping the lower valve means by contact of the closing surface of the lower valve means with the stop means below the piston while the piston is moving downwardly;

shifting the valve positioner with the lower valve means to cause the upper valve means to open the large face of the piston while the stop means is closing the lower valve means to close the small face of the piston thereby reversing the direction of reciprocation.

49. A method of operating a reciprocating fluid powered motor which is installed in a pressurized primary fluid line to drive a reciprocating secondary fluid pump, the reciprocating motor having a housing with fluid inlet and outlet and a controlled path for fluid to pass from the inlet through a stepped piston to the outlet, a stepped piston slidingly mounted for reciprocation in the housing, the piston having a large diameter face and a smaller diameter face each being equipped with a valve set for opening one face and closing the other face at the end of the piston stroke, the method characterized by the following steps:

(a) connecting the inlet and outlet of the housing in the primary fluid line to permit the pressurized primary fluid to follow the controlled path through the housing;

(b) providing a valve shifting assembly including:

an upper control surface in the housing above top dead center position of the piston and a lower control surface in the housing below bottom dead center position of the piston, the valve set of the smaller diameter face comprising valve bodies having an opposed opening and closing surface located on opposite sides of said face, a valve positioner carried by the piston, adapted to carry the valve set for the large diameter face and engage the opening surface of the valve set of the smaller diameter face, the valve positioner being shiftable relative to the piston a distance sufficient to open one of said valve sets and close the other of said valve sets; and a frictional holder for the valve positioner adapted to hold it in alternate stable positions comprising a first stable position corresponding to said valve sets closing the smaller and opening the larger face of the piston and a second stable position corresponding to said valve sets closing the larger and opening the smaller face of the piston and including an intermediate unstable position;

(c) applying primary fluid pressure to the closed large face of the piston to cause the piston to move toward bottom dead center;

(d) stopping the valve set located in the smaller diameter face of the piston and the valve positioner from further movement by bringing said closing surface against the lower control surface while the piston is still moving toward bottom dead center;

(e) shifting the valve positioner relative to the piston from a stable position toward an alternate stable position as the piston continues to move toward bottom dead center;

(f) closing the valve set of the smaller diameter face and substantially simultaneously opening the valve set of the large diameter face of the piston as the valve positioner moves to said alternate stable position to reciprocate the piston toward top dead center;

(g) applying primary fluid pressure to the closed smaller diameter face of the piston to cause the piston to move toward top dead center;

(h) stopping the valve positioner from further movement by bringing said valve positioner against the upper control surface while the piston is still moving toward top dead center;

(i) shifting the valve positioner relative to the piston from said alternate stable position toward said stable position as the piston continues to move toward top dead center;

(j) contacting the opening surface of the valve set of the smaller diameter face of the piston with the valve positioner as the piston continues to move toward top dead center while the valve positioner is being shifted;

(k) closing by means of the valve positioner, the valve set located in the large diameter face while substantially simultaneously opening the valve set in the smaller diameter face of the piston as the valve positioner moves to said stable position, in order to reciprocate the piston toward bottom dead center;

(l) repeating steps c-k to continue reciprocating the piston.

50. The method of claim 49 characterized in that the step of providing a valve shifting assembly includes the step of providing a biasing element associated with each of the upper and lower control surfaces and the step of stopping the valve set located in the smaller diameter face of the piston and the step of stopping the valve positioner includes the step of compressing a biasing element.

51. The method of claim 50 characterized that the step of compressing a biasing element includes the step of applying a shifting force to the valve shifting assembly which will not move the valve positioner from a stable position but will move the valve positioner from the intermediate unstable position to a stable position.

* * * * *